US010655554B2

(12) United States Patent
Koo

(10) Patent No.: US 10,655,554 B2
(45) Date of Patent: May 19, 2020

(54) VEHICLE AND ENGINE-OFF TIMER DIAGNOSIS METHOD THEREOF

(71) Applicants: Hyundai Motor Company, Seoul (KR); Kia Motors Corporation, Seoul (KR)

(72) Inventor: Bon Chang Koo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 101 days.

(21) Appl. No.: 15/959,949

(22) Filed: Apr. 23, 2018

(65) Prior Publication Data

US 2019/0195157 A1 Jun. 27, 2019

(30) Foreign Application Priority Data

Dec. 21, 2017 (KR) ..... 10-2017-0176615

(51) Int. Cl.
*F02D 41/22* (2006.01)
*G07C 5/02* (2006.01)

(52) U.S. Cl.
CPC ..... *F02D 41/22* (2013.01); *G07C 5/02* (2013.01); *F02D 2200/021* (2013.01); *F02D 2200/0414* (2013.01)

(58) Field of Classification Search
CPC ..... F02D 2200/021; F02D 2200/0414; F02D 41/22; G07C 5/02
See application file for complete search history.

(56) References Cited

U.S. PATENT DOCUMENTS 6,314,797 B1 * 11/2001 Dawson ..... F02M 25/0809 73/49.2
6,374,847 B1 * 4/2002 Dawson ..... F02M 25/0809 123/520
10,145,340 B1 * 12/2018 Dudar ..... F02M 35/10222
2002/0043072 A1 * 4/2002 Hamachi ..... B60H 1/00764 62/230
2007/0093952 A1 * 4/2007 Wu ..... B60L 58/10 701/99
2007/0186573 A1 * 8/2007 Ziehr ..... B60H 1/004 62/236

(Continued)

FOREIGN PATENT DOCUMENTS

EP 1950398 A2 * 7/2008 ..... F02D 41/22
JP 2002014702 A 1/2002

(Continued)

*Primary Examiner* — Babar Sarwar
(74) *Attorney, Agent, or Firm* — Mintz Levin Cohn Ferris Glovsky and Popeo, P.C.; Peter F. Corless

(57) ABSTRACT

A vehicle can include: an engine; an engine-off timer configured to detect an engine-off time for which the engine is turned off; an air temperature sensor configured to detect a temperature of air sucked into the engine; a water temperature sensor configured to detect a temperature of water in the engine; and a controller configured to determine whether the engine-off timer is operating normally based on the engine-off time detected by the engine-off timer, the temperature of air sucked into the engine detected by the air temperature sensor, and the temperature of water in the engine detected by the water temperature sensor.

20 Claims, 11 Drawing Sheets

(56) References Cited

U.S. PATENT DOCUMENTS

| | | | | |
|---|---|---|---|---|
| 2008/0178015 | A1* | 7/2008 | Sago | B60W 50/0205 713/300 |
| 2011/0047980 | A1* | 3/2011 | Santoso | B60K 6/48 60/285 |
| 2012/0259501 | A1* | 10/2012 | Mc Donald | F01M 11/12 701/29.5 |
| 2013/0033374 | A1* | 2/2013 | Nakajima | B60Q 5/008 340/466 |
| 2013/0206115 | A1* | 8/2013 | Kragh | F02M 31/20 123/519 |
| 2015/0019107 | A1* | 1/2015 | Whitehead | F02D 41/04 701/102 |
| 2017/0226967 | A1* | 8/2017 | Dudar | F02M 25/0818 |
| 2017/0232949 | A1* | 8/2017 | Tao | F16H 57/0413 701/60 |
| 2017/0341487 | A1* | 11/2017 | Lee | F02N 11/0829 |
| 2019/0031182 | A1* | 1/2019 | Park | B60W 20/40 |
| 2019/0040822 | A1* | 2/2019 | Dudar | F02M 25/0827 |
| 2019/0120101 | A1* | 4/2019 | Dadam | F01N 1/163 |
| 2019/0178181 | A1* | 6/2019 | Lupescu | F02D 41/025 |

FOREIGN PATENT DOCUMENTS

| | | | | |
|---|---|---|---|---|
| JP | 2008181323 | A | | 8/2008 |
| JP | 2009191743 | A | | 8/2009 |
| JP | 2010197104 | A | | 9/2010 |
| JP | 2013124604 | A | | 6/2013 |
| KR | 101013665 | B1 | | 2/2011 |
| KR | 20130042317 | A | * | 4/2013 |
| KR | 1020130042317 | A | | 4/2013 |

* cited by examiner

VEHICLE AND ENGINE-OFF TIMER DIAGNOSIS METHOD THEREOF

CROSS-REFERENCE TO RELATED APPLICATION

This application claims the benefit of priority under 35 U.S.C. § 119 to Korean Patent Application No. 10-2017-0176615, filed on Dec. 21, 2017 in the Korean Intellectual Property Office, the disclosure of which is incorporated herein by reference in its entirety.

BACKGROUND

1. Technical Field

The present disclosure relates to a vehicle and method for diagnosing whether an engine-off timer included in the vehicle has an error.

2. Discussion of Related Art

The start button of a vehicle is generally configured to input a command for the driver to perform power shift, and an electronic control unit (ECU) connected to the start button can generate power shift instructions by pressing the start button in the following sequence: OFF->ACC->IG->OFF or OFF->ACC->IG->START. In this context, 'OFF' refers to switching the vehicle into idle mode, 'ACC' refers to an accessory power state in which the engine is not started but battery power is supplied to electronic devices of the vehicle, 'IG' refers to an ignition power state, and 'START' refers to a power-on state. These four states may be classified into a battery power on/off state (OFF and ACC) and an engine on/off state (IG and START).

The vehicle can take into account a period of time for which the engine is turned off to diagnose an evaporator, a water temperature sensor, and an air temperature sensor. A device used to measure the period for which the engine is turned off is called an engine-off timer. The engine-off timer operates even in the 'OFF' state in which battery power is not supplied to the vehicle. Accordingly, a period exists during which fault diagnosis is impossible by an electronic control device. Therefore, there is a need for a diagnosis method to determine measurements of the engine-off timer produced in the OFF period during which the fault diagnosis is impossible.

SUMMARY OF THE DISCLOSURE

The present disclosure provides a vehicle and engine-off timer diagnosis method thereof, capable of diagnosing whether the engine-off timer is normally operating in a period during which no power is applied, based on outcomes of a water temperature sensor and a air temperature sensor of the vehicle.

In accordance with embodiments of the present disclosure, a vehicle can include: an engine; an engine-off timer configured to detect an engine-off time for which the engine is turned off; an air temperature sensor configured to detect a temperature of air sucked into the engine; a water temperature sensor configured to detect a temperature of water in the engine; and a controller configured to determine whether the engine-off timer is operating normally based on the engine-off time detected by the engine-off timer, the temperature of air sucked into the engine detected by the air temperature sensor, and the temperature of water in the engine detected by the water temperature sensor.

The controller may compare a first temperature detected by the water temperature sensor at a time when the vehicle is in a key-off state after the engine is operated and a second temperature detected by the water temperature sensor at a time when the vehicle is in a key-on state after the key-off state with a preset temperature, respectively, and determine whether the engine-off timer is operating normally based on the engine-off time detected by the engine-off timer when the first and second temperatures are less than the preset temperature.

The controller may compare a first temperature detected by the air temperature sensor at a time when the vehicle is in a key-off state after the engine is operated and a second temperature detected by the air temperature sensor at a time when the vehicle is in a key-on state after the key-off state with a preset temperature, respectively, and determine whether the engine-off timer is operating normally based on the engine-off time detected by the engine-off timer when the first and second temperatures are less than the preset temperature.

The controller may determine whether the engine-off timer is operating normally by comparing the engine-off time detected by the engine-off timer with a preset time.

The controller may determine whether a cooling start condition of the engine is satisfied based on a temperature detected by the water temperature sensor and a temperature detected by the air temperature sensor at a time when the vehicle is in a key-on state, and determine whether the engine-off timer is operating normally when the cooling start condition is satisfied.

The controller may determine whether a warm-up state is satisfied based on the first temperature detected by the water temperature sensor at the time when the vehicle is in the key-off state after the engine is operated, and determine whether the engine-off timer is operating normally when the warm-up condition is satisfied.

The controller may make no determination of whether the engine-off timer is operating normally when the first and second temperatures detected by the water temperature sensor exceed the preset temperature.

The controller may make no determination of whether the engine-off timer is operating normally when the first and second temperatures detected by the air temperature sensor exceed the preset temperature.

The vehicle may further include an output configured to output a result of whether the engine-off time is operating normally.

Furthermore, in accordance with embodiments of the present disclosure, an engine-off timer diagnosis method of a vehicle can include: detecting an engine-off time for which an engine of the vehicle is turned off using an engine-off timer; determining a temperature of air sucked into the engine which is detected using an air temperature sensor; determining a temperature of water of the engine which is detected using a water temperature sensor; and determining whether the engine-off timer is operating normally based on the engine-off time detected by the engine-off timer, the temperature of air sucked into the engine detected by the air temperature sensor, and the temperature of water in the engine detected by the water temperature sensor.

The determining of whether the engine-off timer is operating normally may include: comparing a first temperature detected by the water temperature sensor at a time when the vehicle is in a key-off state after the engine is operated and a second temperature detected by the water temperature sensor at a time when the vehicle is in a key-on state after the key-off state with a preset temperature, respectively; and determining whether the engine-off timer is operating normally based on the engine-off time detected by the engine-off timer when the first and second temperatures are less than the preset temperature.

The determining of whether the engine-off timer is operating normally may include comparing: comparing a first temperature detected by the air temperature sensor at a time when the vehicle is in a key-off state after the engine is operated and a second temperature detected by the air temperature sensor at a time when the vehicle is back in a key-on state after the key-off state with a preset temperature, respectively, and determining whether the engine-off timer is operating normally based on the engine-off time detected by the engine-off timer when the first and second temperatures are less than the preset temperature.

The determining of whether the engine-off timer is operating normally may include determining whether the engine-off timer is operating normally by comparing the engine-off time detected by the engine-off timer with a preset time.

The determining of whether the engine-off timer is operating normally may include: determining whether a cooling start condition of the engine is satisfied based on a temperature detected by the water temperature sensor and a temperature detected by the air temperature sensor at a time when the vehicle is in a key-on state, and determining whether the engine-off timer is operating normally when the cooling start condition is satisfied.

The determining of whether the engine-off timer is operating normally may include: determining whether a warm-up state is satisfied based on the first temperature detected by the water temperature sensor at the time when the vehicle is in the key-off state after the engine is operated, and determining whether the engine-off timer is operating normally when the warm-up condition is satisfied.

The determining of whether the engine-off timer is operating normally may include making no determination of whether the engine-off timer is operating normally when the first and second temperatures detected by the water temperature sensor exceed the preset temperature.

The determining of whether the engine-off timer is operating normally may include making no determination of whether the engine-off timer is operating normally when the first and second temperatures detected by the air temperature sensor exceed the preset temperature.

The method may further include outputting a result of whether the engine-off time is operating normally.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

Figure 1:
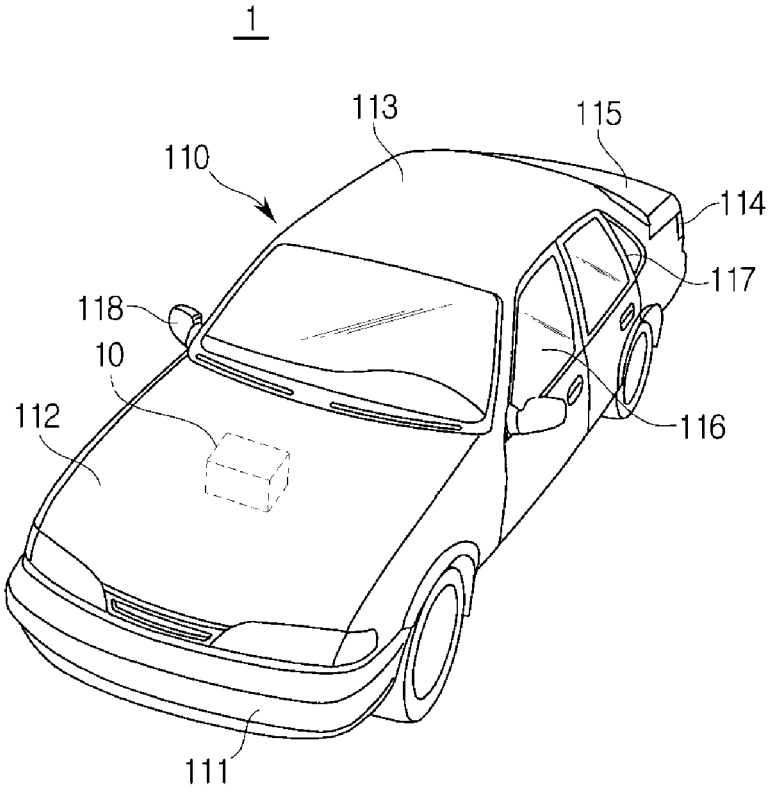
FIG. 1 is an exterior view of a vehicle, according to embodiments of the present disclosure.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF EXEMPLARY EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

Like numerals refer to like elements throughout the specification. Not all elements of embodiments of the present disclosure will be described, and description of what are commonly known in the art or what overlap each other in the embodiments will be omitted. The terms as used throughout the specification, such as "~part", "~module", "~member", "~block", etc., may be implemented in software and/or hardware, and a plurality of "~parts", "~modules", "~members", or "~blocks" may be implemented in a single element, or a single "~part", "~module", "~member", or "~block" may include a plurality of elements.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

Throughout the specification, when it is said that a member is located "on" another member, it implies not only that the member is located adjacent to the other member but also that a third member exists between the two members.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are just used for convenience of explanation, but not to limit an order of the steps. Thus, unless the context clearly dictates otherwise, the written order may be practiced otherwise.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one controller. The term "controller" may refer to a hardware device that includes a memory and a processor. The memory is configured to store program instructions, and the processor is specifically programmed to execute the program instructions to perform one or more processes which are described further below. The control unit may control operation of units, modules, parts, or the like, as described herein. Moreover, it is understood that the below methods may be executed by an apparatus comprising the controller in conjunction with one or more other components, as would be appreciated by a person of ordinary skill in the art.

Furthermore, the controller of the present disclosure may be embodied as non-transitory computer readable media containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed throughout a computer network so that the program instructions are stored and executed in a distributed fashion, e.g., by a telematics server or a Controller Area Network (CAN).

The principle and embodiments of the present disclosure will now be described with reference to accompanying drawings.

Figure 2:
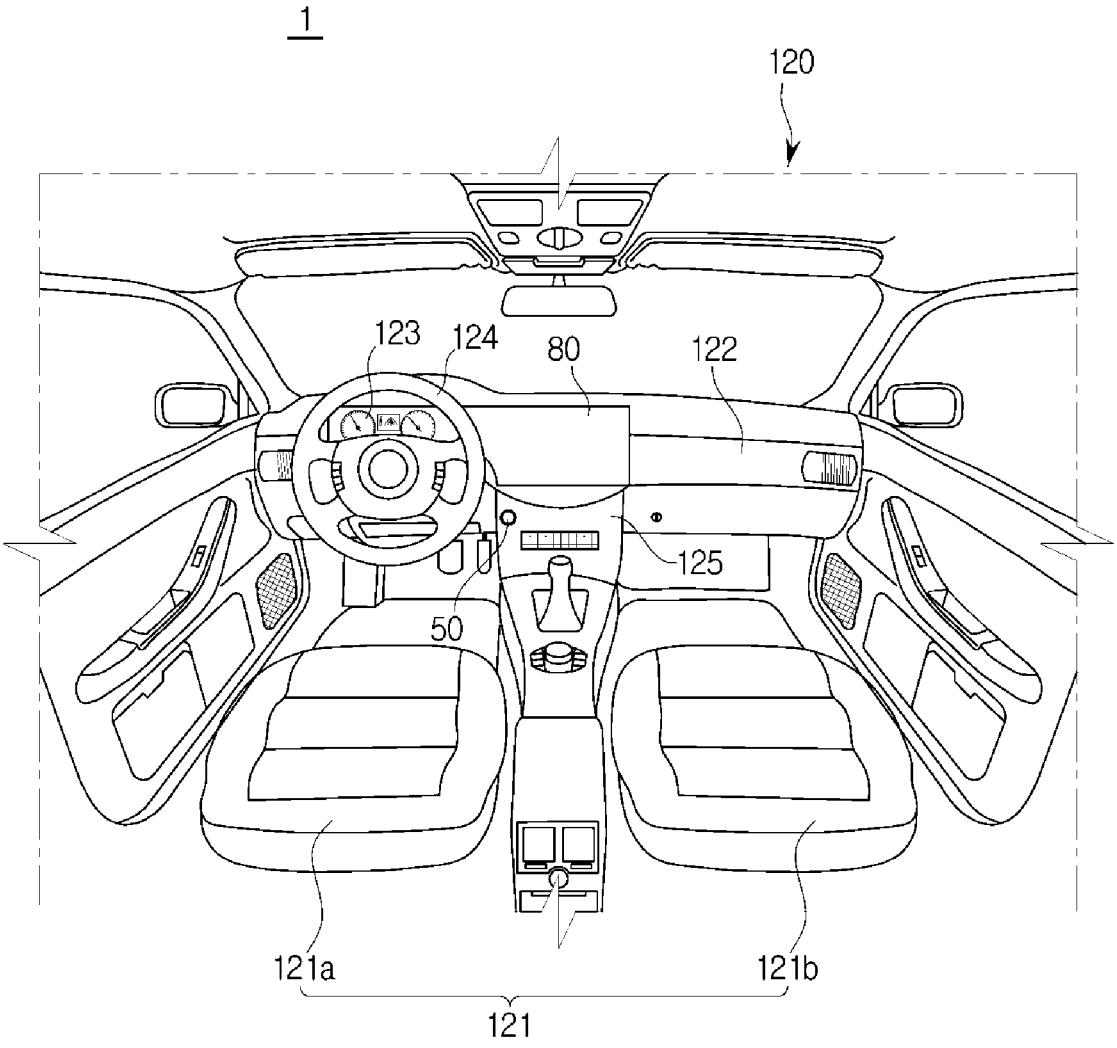
FIG. 2 is an interior view of a vehicle viewed from a backseat, according to embodiments of the present disclosure.

FIG. 1 is an exterior view of a vehicle, according to embodiments of the present disclosure, and FIG. 2 is an interior view of a vehicle viewed from a backseat, according to embodiments of the present disclosure.

The vehicle 1 includes a body with exterior and interior parts, and remaining parts, i.e., chassis on which mechanical devices required for driving are installed.

Referring first to FIG. 1, the exterior part 110 of the body includes a front bumper 111, a hood 112, a roof panel 113, a rear bumper 114, a trunk 115, front, back, left and right doors 116, etc., and further includes a driving system (hereinafter, referred to as an engine) for driving the vehicle 1, i.e., the car wheels.

The exterior part 110 further includes fillers 117 located between the front bumper 111, the hood 112, the roof panel 113, the rear bumper 114, the trunk 115, the front, back, left and right doors.

Further, the exterior part 110 includes side window glasses equipped in the front, back, left and right doors 116, quarter window glasses located between the fillers 118, which may not be opened, a rear window glass installed on the back, a front window glass installed on the front.

The exterior part of the car body further includes side mirrors 118 that helps the driver see areas behind the vehicle 1.

The chassis of the vehicle 1 includes a power generating system, a power transfer system, a traveling gear, a steering system, a braking system, a suspension system, a transmission system, a fuel system, front, rear, left, and right wheels, etc. The vehicle 1 may further include various safety systems for safety of the driver and passengers.

The safety systems may include an airbag control system for the purpose of the safety of driver and passengers in case of car crashes, and an Electronic Stability Control (ESC) system for stabilizing the vehicle's position while the vehicle 1 is accelerating or cornering.

In addition, the vehicle 1 may include a proximity sensor for detecting an obstruction or other cars in the back or to the side of the vehicle 10, a rainfall sensor for detecting precipitation and whether it is raining, etc.

It should be understood that the exterior of the vehicle 1 as shown in FIG. 1 and described above is provided merely for demonstration purposes and does not limit the scope of the present disclosure.

Referring next to FIG. 2, the interior part 120 of the body includes seats 121, a dashboard 122, an instrument panel (or cluster) 123 placed on the dashboard 122, containing gauges and indicators, such as a water temperature gauge, fuel gauge, turn signal indicator, head light indicator, warning light, seat belt warning light, odometer, gearshift position indicator, door open warning light, low fuel warning light, low oil pressure warning light, etc., a steering wheel 124 for steering control of the vehicle, and a center fascia 125 having an audio system and air vents of an air conditioner (AC) arranged thereon.

The seats 121 include a driver seat 121*a*, a passenger seat 121*b*, and backseats arranged in the back of the interior of the vehicle 1.

The cluster 123 may be provided as e.g., an internal display to serve as an output 80 (see FIG. 3) for outputting a water temperature detected by a water temperature sensor of the engine. The cluster 123 may also be used as a device for outputting a result of determining whether an engine-off timer is normal.

The center fascia 125 has a control panel located on the dashboard 122 between the driver seat 121*a* and the passenger seat 121*b* for controlling the audio system, AC, and heater.

Air vents, a cigar jack, a navigation system (AVN), etc., may be installed on the center fascia 125.

The center fascia 125 may serve as another output 80 for receiving information by touching and indicating various information, and may perform a function of the control panel for controlling the audio system, AC, and heater and a function of the AVN as a user interface.

A display equipped on the center fascia 125 may also be used as a device for outputting a result of determining whether an engine-off timer is normal.

The vehicle 1 may further include a start button 50 to input a start command to operate the engine 10.

When the start command is input to the start button 50, i.e., the start button 50 is in the key-on state, the start motor (not shown) of the vehicle 1 starts and drives the engine 10, which is the power generator.

The vehicle 1 further includes a battery (not shown) electrically connected to e.g., an electronic control unit (ECU) for supplying power.

If the start button 50 is in the key-on state, the battery supplies power to the start motor and the ignition device until the ignition is completed, and if the start button 50 is in a key-off state, the battery blocks power from being supplied to devices other than lamps and the start motor to prevent discharge of the battery.

The battery is charged using power of an internal generator or the engine 10 while the vehicle 1 is driven.

It should be understood that the interior of the vehicle 1 as shown in FIG. 2 and described above is provided merely for demonstration purposes and does not limit the scope of the present disclosure.

Figure 3:
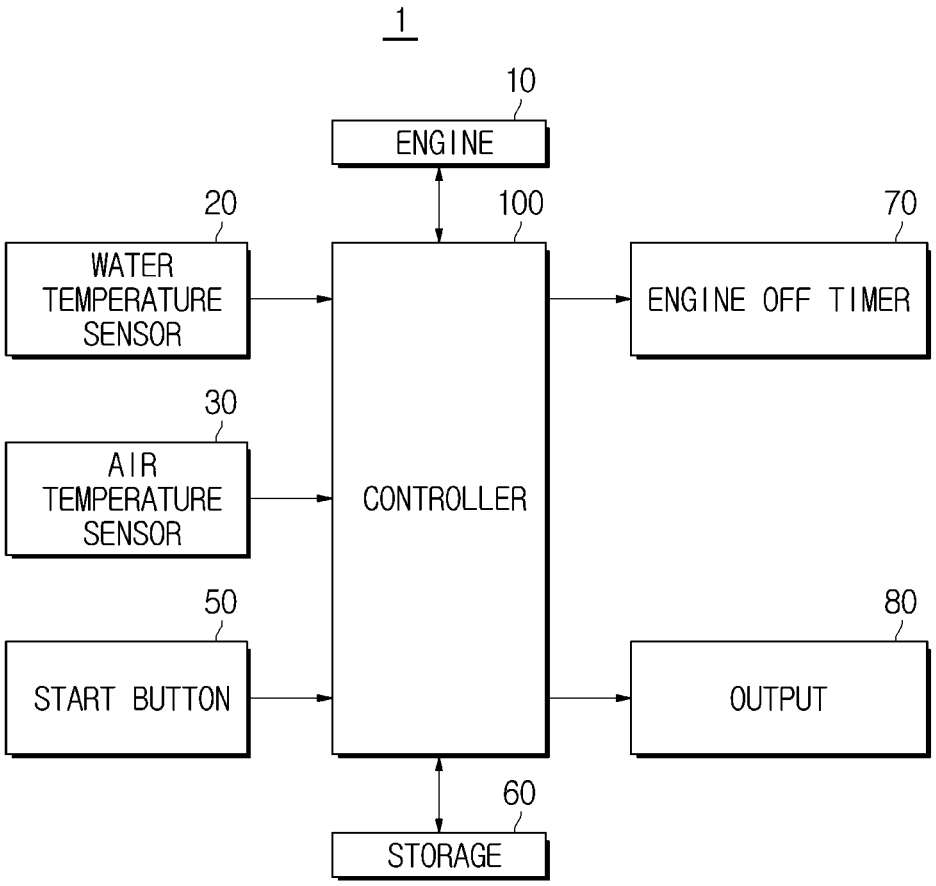
FIG. 3 is a control block diagram of a vehicle, according to embodiments of the present disclosure.

FIG. 3 is a control block diagram of a vehicle, according to embodiments of the present disclosure.

As shown in FIG. 3, the vehicle 1 includes the engine 10 for providing rotational force to the car wheels, a water temperature sensor 20 for detecting the temperature of water of the engine 10, an air temperature sensor 30 for measuring the temperature of the air sucked into the engine 10, the start button 50 for receiving a command to turn on or off the engine 10, a storage 60 for storing detection results of the water temperature sensor 20, the air temperature sensor 30 and the engine-off timer 70, the engine-off timer 70 for detecting duration of the state in which the engine 10 is turned off, the output 80 for outputting whether the engine-off timer 70 is operating normally, and a controller 100 for determining whether the engine-off timer 70 is operating normally and controlling the aforementioned components.

Specifically, the engine 10 may be arranged on the chassis as described above, and may include the water temperature sensor 20 and the air temperature sensor 30.

The engine 10 is switched by the start button 50 between on and off, and the engine on/off is different from the key on/off in which battery power is supplied and e.g., the ECU is turned on.

In other words, the engine-on state is a state in which the engine 10 is switched into the ACC-on state and then the driver manipulates the start button 50 again to start turning on the ignition of the engine 10. In comparison, the engine-off state refers to a state in which the ignition of the engine 10 is turned off (IGN OFF), and includes both ACC-off and ACC-on states.

The water temperature sensor 20 is a resistive sensor for detecting the temperature of water to prevent the engine 10 from being overheated and may be arranged in a water path of the intake manifold of the engine 10.

The water temperature sensor 20 may include a sensor for water temperature gauge such as a thermo-bimetal or a thermistor, for informing the detected water temperature to the controller 100. The controller 100 determines whether a cooling start condition (cycle) and a warm-up condition (cycle) of the engine 10 are satisfied based on the detected value of the water temperature sensor 20 and supplies proper water to cool the engine 10.

The cooling start cycle of the engine 10 is a procedure for determining whether the engine 10 is normally operating, meaning a state in which the engine 10 is normally operating for driving.

The warm-up cycle refers to a state of the engine 10 for determining whether a detected value of the water temperature sensor 20, which corresponds to a condition, is reliable before whether the engine-off timer 70 is operating is determined, and is a procedure for determining whether operation of the engine-off timer 70 is started.

If both the cooling start cycle and the warm-up cycle are satisfied, the vehicle 1 determines whether the engine-off timer 70 (see FIG. 3) is operating normally. This will be described later in more detail with reference to accompanying drawings.

The air temperature sensor 30 is a resistor for measuring the temperature of air sucked into the engine 10, and the controller 100 determines an amount of injection of fuel to be supplied to the engine 10 based on the detected value of the air temperature sensor 30.

The detected value of the air temperature sensor 30 is used to determine the cooling start cycle and whether the engine-off timer 70 is normally operating.

The engine-off timer 70 is a timer for measuring the duration for which the engine 10 is turned off (i.e., "engine-off time"), and is implemented with an Integrated Chip (IC) that operates while no power is supplied to the controller 100 and consumes little current.

If the ACC-on command is input to the start button 50 and the controller 100 is switched into operation mode, the engine-off timer 70 informs the controller 100 of the measurement time and then resets the measurement time.

The output 80 includes the components as described in FIGS. 1 and 2, and corresponds to a user interface for outputting a result of determination of whether the engine-off timer is operating normally for the driver who gets in the vehicle 1.

The controller 100 corresponds to a head unit in charge of controlling overall operation of the vehicle 1, and may be implemented with a memory (not shown) for storing an algorithm to control operation of the components of the vehicle 1 or data about a program that implements the algorithm, and a processor (not shown) for carrying out the aforementioned operation using the data stored in the memory. The memory and the processor may be implemented in separate chips. Alternatively, the memory and the processor may be implemented in a single chip.

The controller 100 determines whether the engine-off timer is operating normally based on detected values of the water temperature sensor 20 and the air temperature sensor 30. The determination procedure of the controller 100 will be described in detail later with reference to accompanying drawings.

The storage 60 is a medium to store detected values of the water temperature sensor 20, the air temperature sensor 30, and the engine-off timer 70 and programs required for operation of the controller 100 and other electronic control devices.

The storage 60 may be implemented with at least one of a non-volatile memory device, such as cache, read only memory (ROM), programmable ROM (PROM), erasable programmable ROM (EPROM), electrically erasable programmable ROM (EEPROM), a volatile memory device, such as random access memory (RAM), or a storage medium, such as hard disk drive (HDD) or compact disk (CD) ROM, without being limited thereto. The storage 60 may be a memory implemented with a chip separate from the aforementioned processor in relation to the controller 100, or may be implemented integrally with the processor in a single chip.

At least one component may be added or deleted to correspond to the performance of the components of the vehicle shown in FIG. 3. Furthermore, it will be obvious to the ordinary skilled people in the art that the relative positions of the components may be changed to correspond to the system performance or structure.

The components of the vehicle 1 as shown in FIG. 3 may be implemented in software, or hardware such as Field Programmable Gate Arrays (FPGAs) and Application Specific Integrated Circuits (ASICs).

Figure 4:
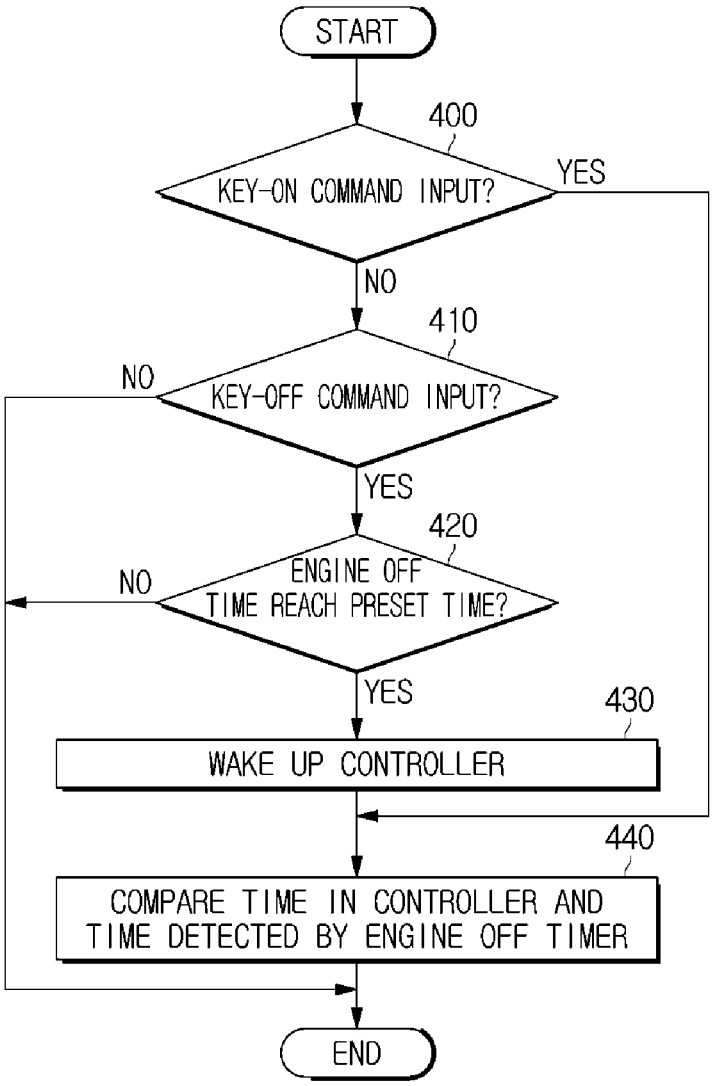
FIG. 4 is a flowchart illustrating a conventional procedure of determining whether an engine-off timer is operating normally.

FIG. 4 is a flowchart illustrating a conventional procedure of determining whether an engine-off timer is operating normally.

As shown in FIG. 4, the driver inputs a key-on input command through the start button 50, in 400.

The key-on input command refers to an ACC-on command or a battery-on command to supply battery power to the controller 100 and components of the vehicle 1.

When the key-on input command is input, the controller 100 compares time measured from inside of the CPU and time informed by the engine-off timer 70, in 440.

On the other hand, the driver inputs a key-off input command through the start button 50, in 410.

The key-off input command refers to a command for a state in which the battery power is not supplied, i.e., the ACC-off and IGN-off state. While the battery power is not supplied, a conventional vehicle switches the controller 100 into operation mode at regular intervals to determine whether the engine-off timer 70 is normally operating.

In other words, whether a time for which the engine has been switched off reaches a predetermined time, in 420.

For example, the predetermined time is about 80 minutes, and if every interval time is satisfied, the controller 100 enters the operation mode, i.e., the controller 100 is woken up, in 430.

Subsequently, the controller 100 compares time measured from inside of the CPU and time informed by the engine-off timer 70, in 440.

In other words, a diagnostic logic of the conventional engine-off timer allows the battery power to be periodically supplied to the controller 100 to determine whether the engine-off timer is normally operating.

In comparison, the vehicle 1 in accordance with embodiments of the present disclosure determines whether the engine-off timer 70 is normally operating when the driver inputs the key-on input command, without need to be voluntarily switched into the operation mode.

Figure 5:
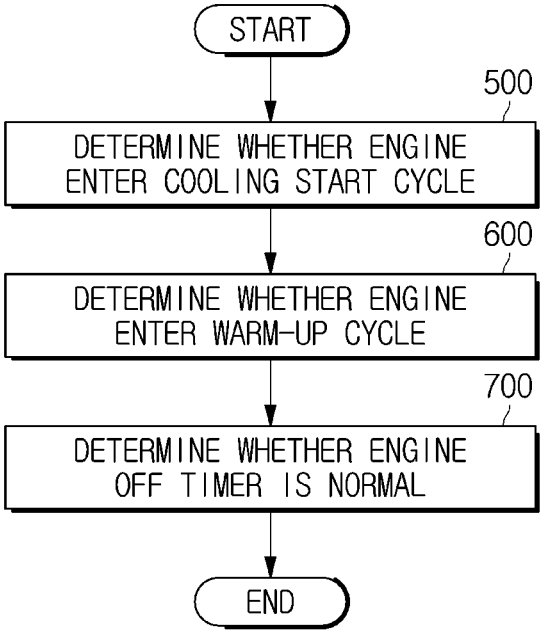
FIG. 5 is a flowchart illustrating a procedure of determining whether the engine-off timer is operating normally, according to embodiments of the present disclosure.
Figure 6:
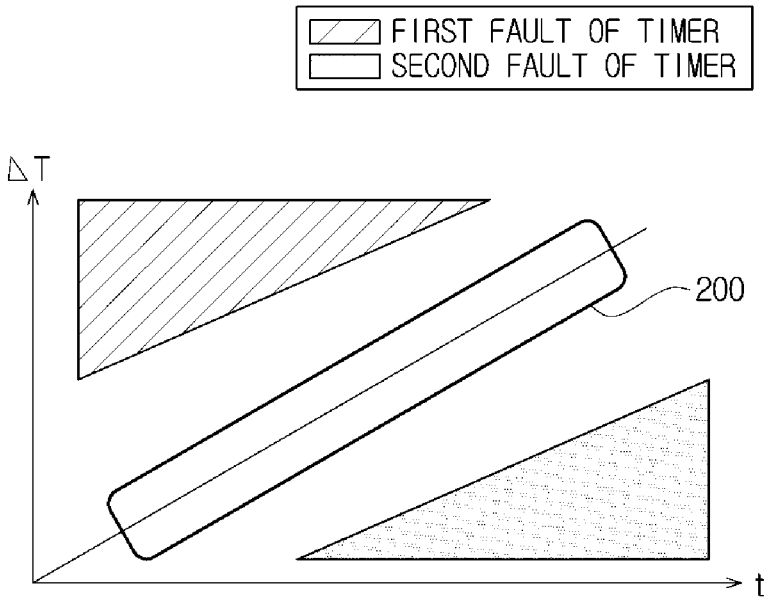
FIG. 6 is a graph for classification of faults of an engine-off timer.

FIG. 5 is a flowchart illustrating how to determine whether the engine-off timer is operating normally, according to embodiments of the present disclosure, and FIG. 6 is a graph for classification of faults of an engine-off timer.

The vehicle 1 makes a diagnosis of the engine-off timer 70 based on a relation to whether the engine 10 is cooled in the key-off state.

Referring first to FIG. 5, determination of normality includes determining whether the engine enters the cooling start cycle in 500, determining whether the engine enters the warm-up cycle in 600, and determining whether the engine-off timer is operating normally in 700.

FIG. 6 is a graph of classifying the results determined in 700 of FIG. 5 into first and second faults, where the x-axis represents time and the y-axis represents temperature differences of detected values of the water temperature sensor 20 or the air temperature sensor 30 over time.

Especially, time on the x-axis is the soaking time to measure engine-off time of the engine-off timer, and may vary from several seconds to several hours.

As the time for which the engine 10 is turned off increases, the engine 10 is cooled further. Accordingly, the temperature difference of the detected values of the water temperature sensor 20 and the air temperature sensor 30 may increase at a key-on time after key-off. Based on this, the vehicle 1 determines whether the engine-off timer 70 is operating normally.

Specifically, the aforementioned relation may be classified into a normal condition 200, a first fault condition in which the engine-off timer 70 is stuck to an abnormally small initial time or the time of the engine-off timer 70 is delayed as compared with the normal condition 200, and a second fault condition in which the engine-off timer 70 is stuck to an abnormally large time or the time of the engine-off timer 70 is advanced as compared with the normal condition 200.

In other words, determining whether the engine-off timer 70 is operating normally in 700 of FIG. 5 includes sequentially determining the first fault and the second fault.

The entire procedure of determining whether the engine-off timer 70 is operating normally will now be described in detail in connection with FIGS. 7 to 11.

Figure 7:
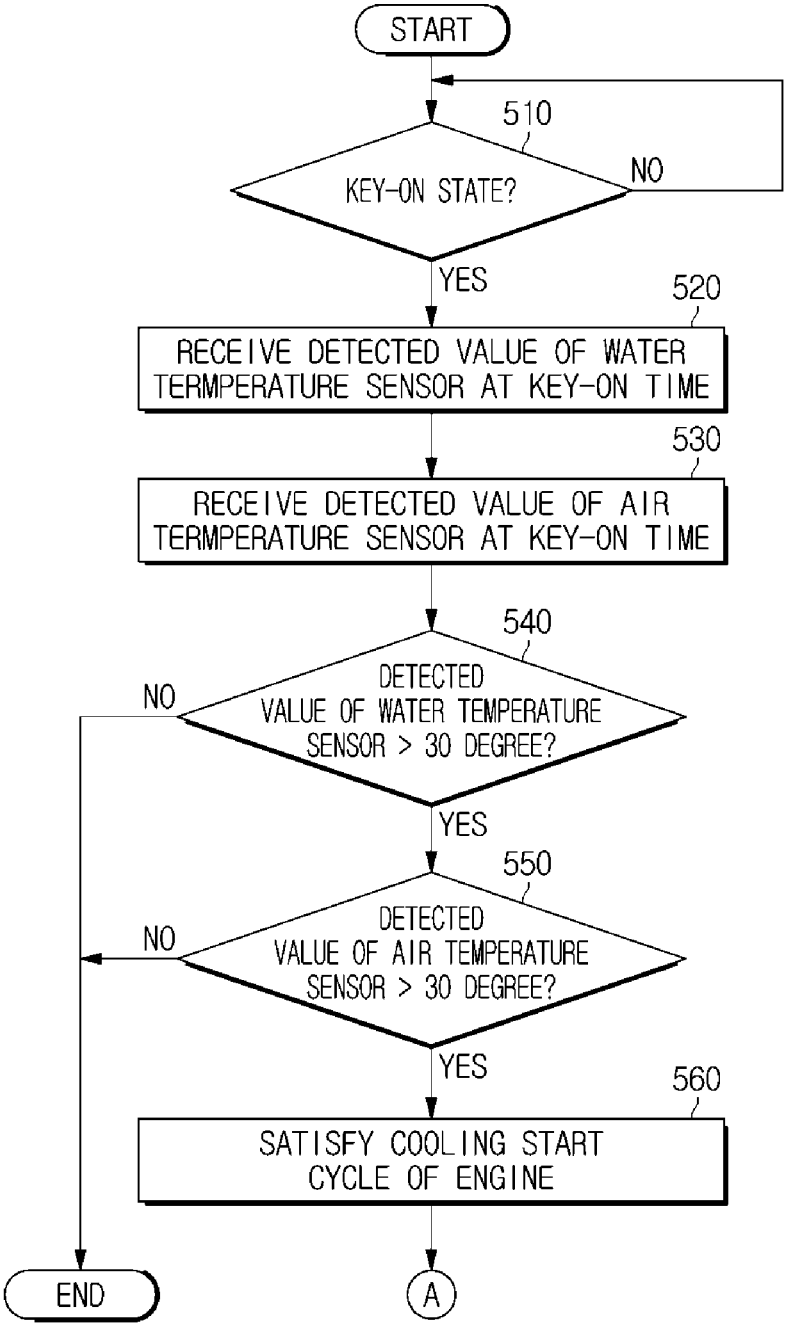
FIG. 7 is a flowchart for illustrating a procedure of determining a cooling start cycle of an engine.

FIG. 7 is a flowchart for illustrating a procedure of determining a cooling start cycle of an engine.

To determine the cooling start cycle, i.e., to determine whether the engine is normally operating, the vehicle 1 determines whether it is in the key-on state, in 510.

The vehicle 1 overcomes the traditional problem that normality of the engine-off timer cannot be determined while the engine is in the key-off state by determining the normality of the engine-off timer based on detected values of a condition of the engine 10 in the key-on state.

The controller 100 receives a detected value of the water temperature sensor 20 at the key-on time from the water temperature sensor 20, in 520.

Furthermore, the controller 100 receives a detected value of the air temperature sensor 30 at the key-on time, in 530.

The controller 100 determines whether the detected value of the water temperature value 20 exceeds a preset temperature, in 540.

For example, the preset temperature may be about 30 degrees.

If the detected value of the water temperature sensor 20 exceeds the preset temperature, the controller 100 determines whether the detected value of the air temperature sensor 30 exceeds a preset temperature, in 550.

For example, the preset temperature may be about 30 degrees.

If the detected value of the water temperature sensor 20 or the air temperature sensor 30 does not exceed the preset temperature, checkup for the engine-off timer 70 does not proceed.

On the contrary, if the detected value of the water temperature sensor 20 and the detected value of the air temperature sensor 30 both exceed the respective preset temperatures, the controller 100 determines the cooling start cycle of the engine 10, i.e., determines that the engine 10 is stably operating.

Subsequently, the controller 100 determines whether the warm-up cycle of the engine 10 has proceeded, in A.

Figure 8:
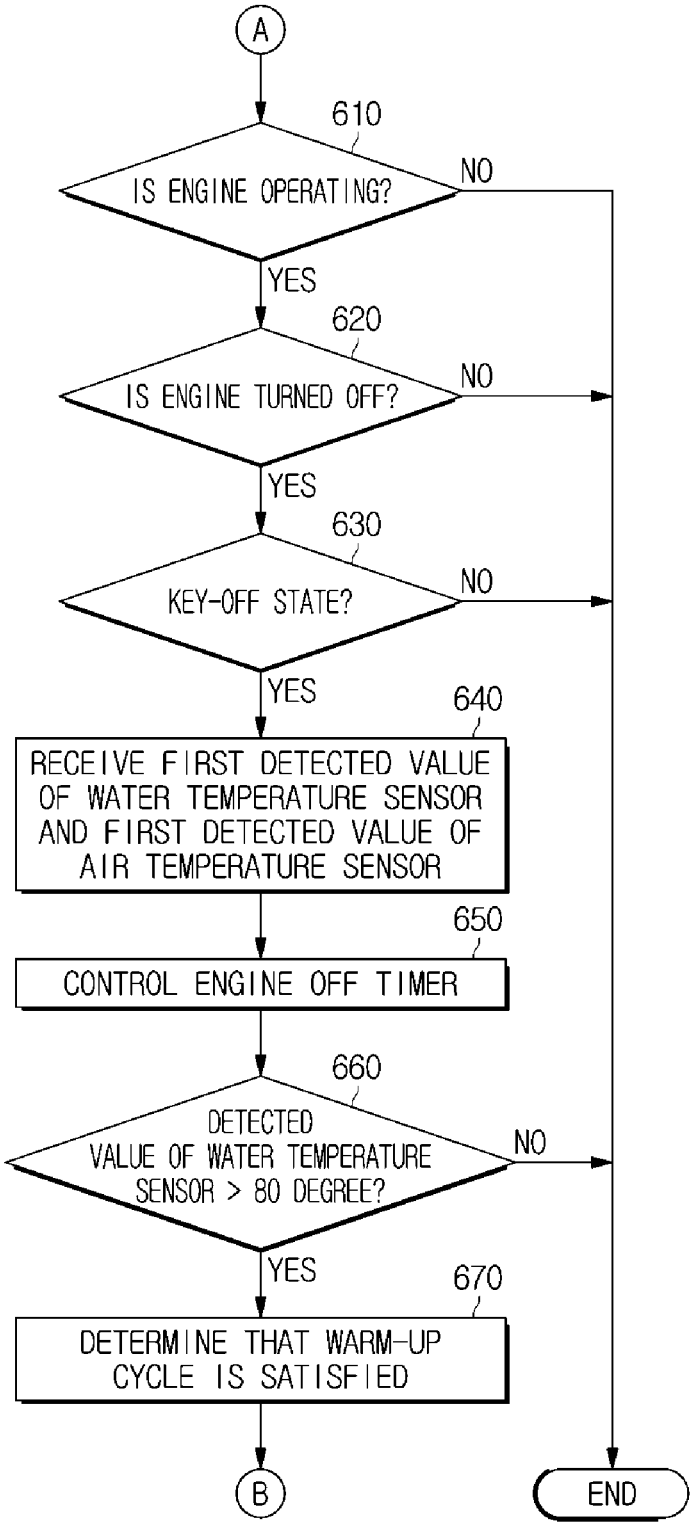
FIG. 8 is a flowchart for illustrating a procedure of determining a warm-up cycle of an engine.

FIG. 8 is a flowchart for illustrating a procedure of determining a warm-up cycle of an engine.

Referring to FIG. 8, the controller 100 determines whether the engine 10 continues to operate, in 610.

First, it is determined whether the engine 10 is normally operating, in 610.

If the engine 10 is normally operating, the controller 100 monitors the engine-off state, i.e., whether an engine-off command is received.

The controller 100 determines whether it is in the engine-off state by the user, in 620.

The engine-off state may be a state in which an IGN-off or ACC-on command is received from the start button 50.

If the engine 10 is turned off, the controller 50 determines from the start button 50 whether it is in the key-off state, 630.

The key-off state refers to a state in which battery power is not supplied to components of the vehicle 1, which corresponds to the ACC-off state.

If it is in the key-off state, the controller 100 receives a detected value (temperature), hereinafter, called a first detected value, of the water temperature sensor 20 and a detected value (temperature), hereinafter, called a first detected value, of the air temperature sensor 30, in 640.

The first detected value of the water temperature sensor 20 and the first detected value of the air temperature value 30 both indicate a condition of the engine at the time when the key-off command is issued, i.e., at key-off time, after the engine 1 operates normally.

Upon reception of the detected values 20, 30, the controller 100 controls the engine-off timer 70 to start to measure time in the engine-off state.

On the other hand, if the engine is not operating, or if the engine is not switched into the engine-off state while operating, or if the key-off command is not applied, determination of whether the engine-off timer is operating normally is not made.

The controller 100 compares the first detected value sent from the water temperature sensor 20 with a preset temperature to determine whether the warm-up cycle is satisfied, in 660.

For example, the preset temperature may be about 80 degrees.

If the first detected value of the water temperature sensor 20 does not exceed the preset temperature, the controller 100 makes no determination of whether the engine-off timer 70 is normally operating even if the engine is turned on again.

Otherwise, if the first detected value of the water temperature sensor 20 exceeds the preset temperature, the controller 100 determines whether the engine-off timer 70 is normally operating when the engine is turned on from the off state, in B.

Figure 9:
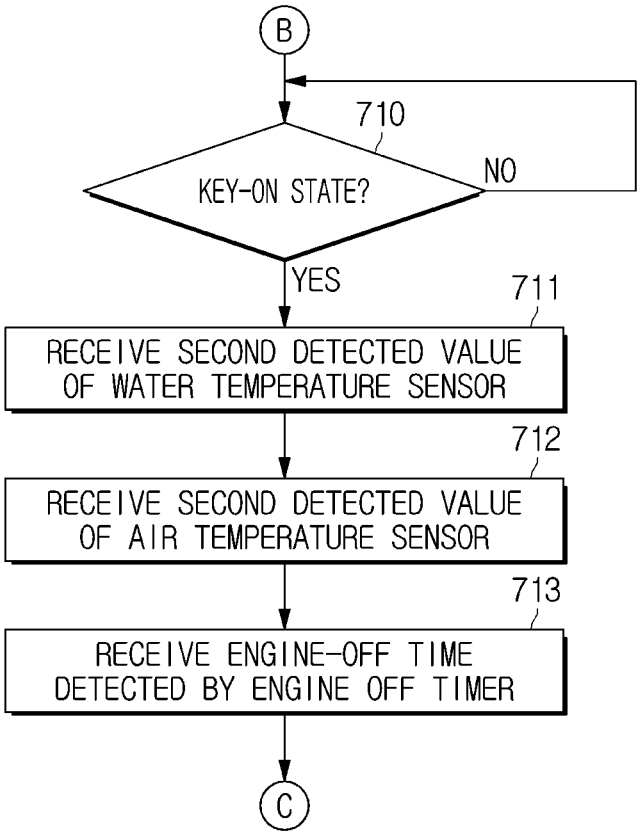
FIGS. 9 to 11 are a flowchart illustrating a detailed procedure of determining whether an engine-off timer is operating normally.
Figure 10:
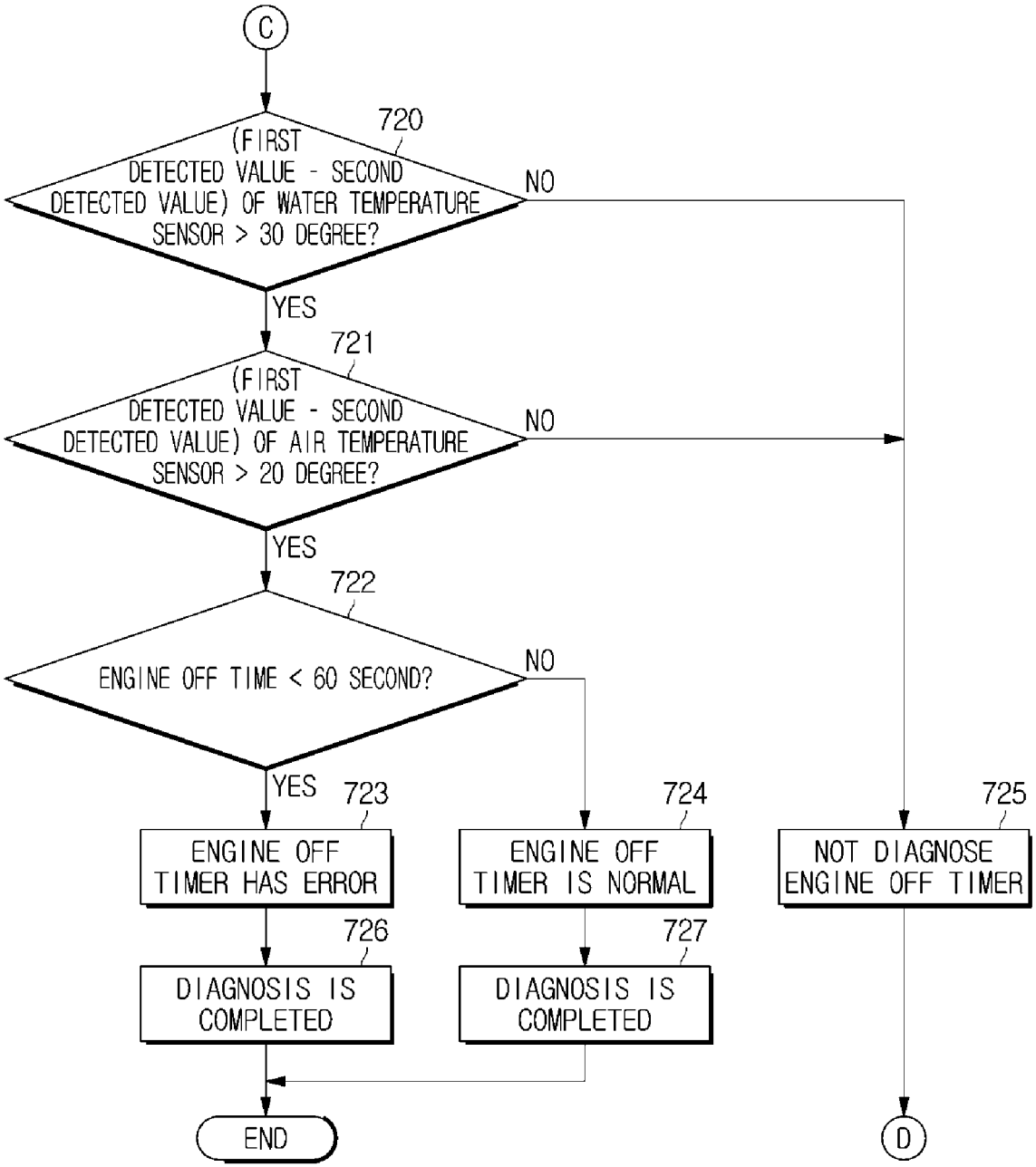
Figure 11:
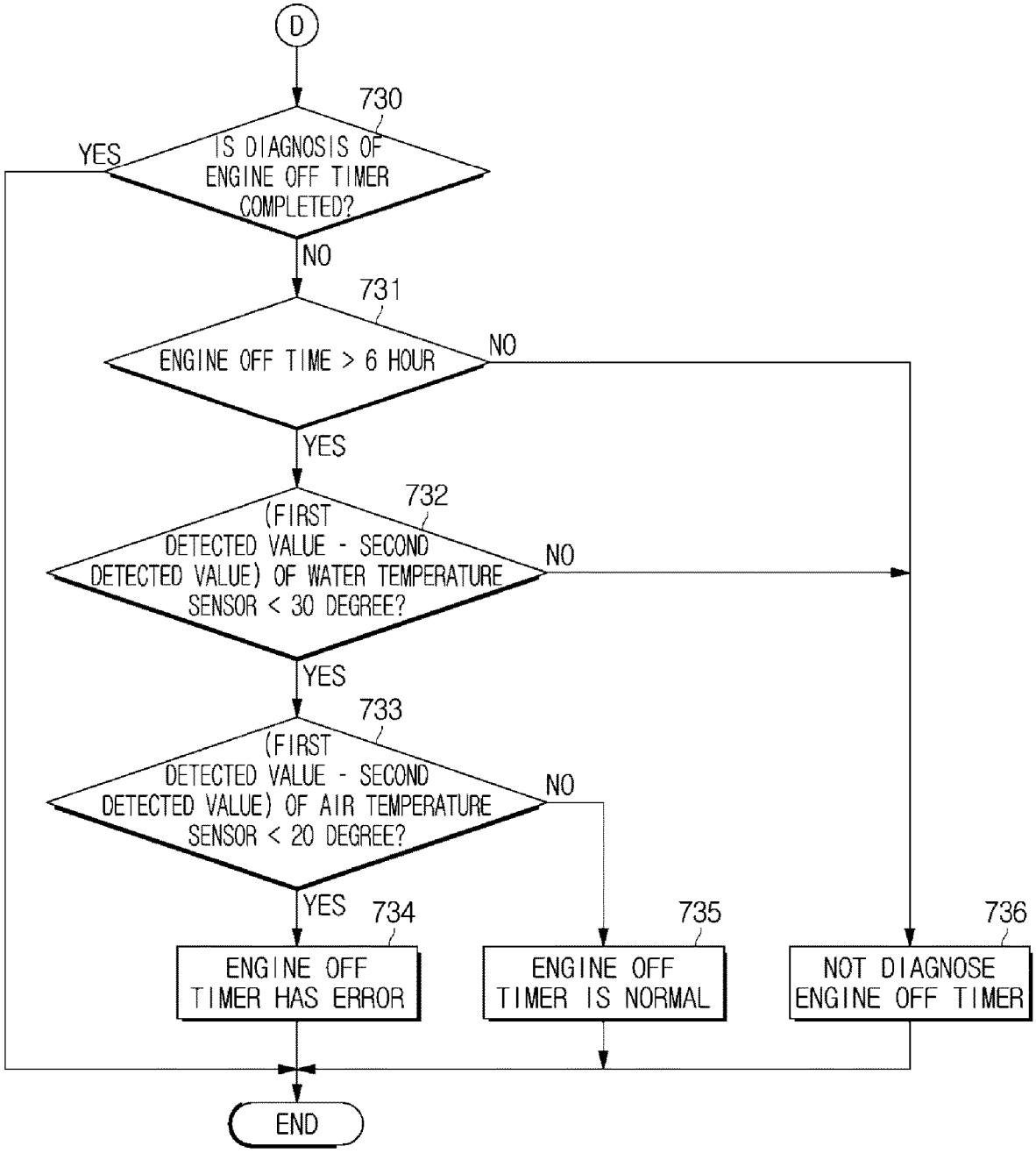

FIGS. 9 to 11 are a flowchart illustrating a detailed procedure of determining whether an engine-off timer is normally operating. The embodiment will be described in connection with FIGS. 18 and 19 together to avoid overlapping explanation.

Referring first to FIG. 9, the controller 100 determines whether it is in the key-on state, in 710.

The key-on state refers to a state in which the driver inputs the ACC-on input command to the start button 50 while the engine-off timer 70 is operating after the engine is turned off. Furthermore, satisfying the key-on condition refers to satisfying both the cooling start cycle and the warm-up cycle.

The controller 100 receives a detected water temperature value (hereinafter, called a second detected value of water temperature) from the water temperature sensor 20 at a time when the key-on command is input, in 711.

The controller 100 also receives a detected air temperature value (hereinafter, called a second detected value of air temperature) from the air temperature sensor 30 at the time when the key-on command is input, in 712.

Finally, the controller 100 receives time measured by the engine-off timer 70 while the engine is turned off, i.e., engine-off time, in 713.

The engine-off timer 70 informs the controller 100 of the engine-off time and is reset.

The controller 100 determines whether the engine-off timer 70 is normally operating based on the second detected value of the water temperature, the second detected value of the air temperature, and the first detected value of the water temperature detected at the engine-off time and in the warm-up cycle, in C.

Referring to FIG. 10, the controller 100 compares the first and second detected values of the water temperature sensor 20, in 720.

Specifically, the first detected value of the water temperature sensor 20 corresponds to a detected value of the water temperature sensor 20 detected in the warm-up cycle, and the second detected value corresponds to a detected value detected at an ending point in the soaking time at which the engine-off timer 70 measures the engine-off time.

If the difference between the first and second detected values of the water temperature sensor 20 exceeds about 30 degrees, the controller 100 compares detected values of the air temperature sensor 30, in 721.

If the difference between the first and second detected values of the air temperature sensor 30 exceeds about 20 degrees, the controller 100 compares the engine-off time with a preset time, in 722.

The preset temperatures of 30 and 20 degrees may vary like the aforementioned various set values.

Alternatively, comparing the first and second detected values of the water temperature sensor 20 may be performed after the first and second detected values of the air temperature sensor 30 are compared.

If the difference between the first and second detected values of the water temperature sensor 20 or the air temperature sensor 30, respectively, does not exceed the preset temperature, the controller 100 makes no determination of whether the engine-off timer 70 is normally operating, in 725.

In the meantime, for example, comparing the engine-off time with the preset time includes determining whether the engine-off time exceeds sixty minutes.

If the engine-off time does not exceed sixty minutes, the controller 100 determines that the engine-off timer 70 has an error, in 723.

The controller 100 also determines that diagnosis of the engine-off timer 70 is completed, in 726.

The determination that the engine-off timer 70 has an error corresponds to the first fault of FIG. 6.

The controller 100 may give a warning to the driver through the output 80 saying that the engine-off timer 70 is not operating normally. If it is determined that the engine-off timer 70 has an error, the controller 100 determines whether the error of the engine-off timer 70 corresponds to the second fault, in D.

If the engine-off time exceeds sixty minutes, the controller 100 determines that the engine-off timer 70 is operating normally and completes the diagnosis, in 724, 727.

The preset time is not limited to sixty minutes but may vary.

Referring now to FIG. 11, the controller 100 determines whether the diagnosis of the engine-off timer 70 is completed, in 730.

If the diagnosis of the engine-off timer 70 is completed in 726 or 727 as described above in connection with FIG. 10, the controller 100 does not perform the procedure of FIG. 11.

Otherwise, if the diagnosis of the engine-off timer 70 is not completed in 725, i.e., the engine-off timer 70 has not yet been diagnosed, the controller 100 performs the procedure D from operation 730.

The controller 100 determines whether the engine-off time informed from the engine-off timer 70 exceeds a preset time, in 731.

For example, the preset time may be about six hours. The procedure D of FIG. 11 diagnoses the second fault as described above in connection with FIG. 5.

If the engine-off time does not exceed the preset time, the procedure D of diagnosing the engine-off timer 70 is not performed in 736.

In other words, the requirement for performing the engine-off timer diagnosis method is not satisfied, so the result of diagnosing whether the engine-off timer 70 is normally or abnormally operating is not output.

On the other hand, if the engine-off time exceeds the preset time, the controller 100 compares the first and second detected values of the water temperature sensor 20, in 732.

If the difference between the first and second detected values of the water temperature sensor 20 is not less than about 30 degrees, the procedure of diagnosing the engine-off timer 70 is not performed, in 736.

If the difference between the first and second detected values of the water temperature sensor 20 is less than about 30 degrees, the controller 100 compares detected values of the air temperature sensor 30, in 733.

If the difference between the first and second detected values of the air temperature sensor 30 is less than about 20 degrees, the controller 100 determines that the engine-off timer 70 has an error, in 734.

If the difference between the first and second detected values of the air temperature sensor 30 is not less than about 20 degrees, the controller 100 determines that the engine-off timer 70 is operating normally, in 735.

The controller 100 may control the output 80 to inform the driver or someone of the result of determining whether the engine-off timer 70 is operating normally.

The preset reference of 30 or 20 degrees is only by way of example, and may vary in other embodiments.

According to embodiments of the present disclosure, a vehicle and engine-off timer diagnosis method thereof may be able to diagnose whether the engine-off timer is normally operating in a period during which no power is applied, based on outcomes of the water temperature sensor and the air temperature sensor. In addition, the vehicle and engine-off timer diagnosis method thereof may improve accuracy of the engine-off timer and thus secure stability of the starter of the vehicle.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A vehicle comprising:

an engine;

an engine-off timer configured to detect an engine-off time for which the engine is turned off;

an air temperature sensor configured to detect a temperature of air sucked into the engine;

a water temperature sensor configured to detect a temperature of water in the engine; and a controller configured to determine whether the engine-off timer is operating normally based on the engine-off time detected by the engine-off timer, the temperature of air sucked into the engine detected by the air temperature sensor, and the temperature of water in the engine detected by the water temperature sensor.

2. The vehicle of claim 1, wherein the controller is further configured to:

compare a first temperature detected by the water temperature sensor at a time when the vehicle is in a key-off state after the engine is operated and a second temperature detected by the water temperature sensor at a time when the vehicle is in a key-on state after the key-off state with a preset temperature, respectively, and determine whether the engine-off timer is operating normally based on the engine-off time detected by the engine-off timer when the first and second temperatures are less than the preset temperature.

3. The vehicle of claim 2, wherein the controller is further configured to determine whether the engine-off timer is operating normally by comparing the engine-off time detected by the engine-off timer with a preset time.

4. The vehicle of claim 2, wherein the controller is further configured to:

determine whether a warm-up state is satisfied based on the first temperature detected by the water temperature sensor at the time when the vehicle is in the key-off state after the engine is operated, and determine whether the engine-off timer is operating normally when the warm-up condition is satisfied.

5. The vehicle of claim 2, wherein the controller is further configured to make no determination of whether the engine-off timer is operating normally when the first and second temperatures detected by the water temperature sensor exceed the preset temperature.

6. The vehicle of claim 1, wherein the controller is further configured to:

compare a first temperature detected by the air temperature sensor at a time when the vehicle is in a key-off state after the engine is operated and a second temperature detected by the air temperature sensor at a time when the vehicle is in a key-on state after the key-off state with a preset temperature, respectively, and determine whether the engine-off timer is operating normally based on the engine-off time detected by the engine-off timer when the first and second temperatures are less than the preset temperature.

7. The vehicle of claim 6, wherein the controller is further configured to determine whether the engine-off timer is operating normally by comparing the engine-off time detected by the engine-off timer with a preset time.

8. The vehicle of claim 6, wherein the controller is further configured to make no determination of whether the engine-off timer is operating normally when the first and second temperatures detected by the air temperature sensor exceed the preset temperature.

9. The vehicle of claim 1, wherein the controller is further configured to:

determine whether a cooling start condition of the engine is satisfied based on a temperature detected by the water temperature sensor and a temperature detected by the air temperature sensor at a time when the vehicle is in a key-on state, and determine whether the engine-off timer is operating normally when the cooling start condition is satisfied.

10. The vehicle of claim 1, further comprising:

an output configured to output a result of whether the engine-off time is operating normally.

11. An engine-off timer diagnosis method of a vehicle, the method comprising:

detecting an engine-off time for which an engine of the vehicle is turned off using an engine-off timer;

determining a temperature of air sucked into the engine which is detected using an air temperature sensor;

determining a temperature of water of the engine which is detected using a water temperature sensor; and determining whether the engine-off timer is operating normally based on the engine-off time detected by the engine-off timer, the temperature of air sucked into the engine detected by the air temperature sensor, and the temperature of water in the engine detected by the water temperature sensor.

12. The method of claim 11, wherein the determining of whether the engine-off timer is operating normally comprises:

comparing a first temperature detected by the water temperature sensor at a time when the vehicle is in a key-off state after the engine is operated and a second temperature detected by the water temperature sensor at a time when the vehicle is in a key-on state after the key-off state with a preset temperature, respectively; and determining whether the engine-off timer is operating normally based on the engine-off time detected by the engine-off timer when the first and second temperatures are less than the preset temperature.

13. The method of claim 12, wherein the determining of whether the engine-off timer is operating normally comprises:

determining whether the engine-off timer is operating normally by comparing the engine-off time detected by the engine-off timer with a preset time.

14. The method of claim 12, wherein the determining of whether the engine-off timer is operating normally comprises:

making no determination of whether the engine-off timer is operating normally when the first and second temperatures detected by the air temperature sensor exceed the preset temperature.

15. The method of claim 11, wherein the determining of whether the engine-off timer is operating normally comprises:

comparing a first temperature detected by the air temperature sensor at a time when the vehicle is in a key-off state after the engine is operated and a second temperature detected by the air temperature sensor at a time when the vehicle is back in a key-on state after the key-off state with a preset temperature, respectively, and determining whether the engine-off timer is operating normally based on the engine-off time detected by the engine-off timer when the first and second temperatures are less than the preset temperature.

16. The method of claim 11, wherein the determining of whether the engine-off timer is operating normally comprises:

determining whether the engine-off timer is operating normally by comparing the engine-off time detected by the engine-off timer with a preset time.

17. The method of claim 11, wherein the determining of whether the engine-off timer is operating normally comprises:

determining whether a cooling start condition of the engine is satisfied based on a temperature detected by the water temperature sensor and a temperature detected by the air temperature sensor at a time when the vehicle is in a key-on state, and determining whether the engine-off timer is operating normally when the cooling start condition is satisfied.

18. The method of claim 11, wherein the determining of whether the engine-off timer is operating normally comprises:

determining whether a warm-up state is satisfied based on the first temperature detected by the water temperature sensor at the time when the vehicle is in the key-off state after the engine is operated, and determining whether the engine-off timer is operating normally when the warm-up condition is satisfied.

19. The method of claim 11, wherein the determining of whether the engine-off timer is operating normally comprises:

making no determination of whether the engine-off timer is operating normally when the first and second temperatures detected by the water temperature sensor exceed the preset temperature.

20. The method of claim 11, further comprising:

outputting a result of whether the engine-off time is operating normally.

* * * * *